US005378851A

United States Patent [19]

Brooke et al.

[11] Patent Number: 5,378,851

[45] Date of Patent: Jan. 3, 1995

[54] SYSTEM FOR HANDLING A REMOTELY OPERATED VESSEL

[75] Inventors: John Brooke, Halifax; Arnold Furlong, Lower Sackville; Geoff Lebans, Dartmouth, all of Canada

[73] Assignee: Her Majesty in right of Canada as represented by the Minister of Fisheries of Oceans, Ottawa, Canada

[21] Appl. No.: 102,193

[22] Filed: Aug. 5, 1993

[30] Foreign Application Priority Data

Aug. 14, 1992 [CA] Canada ..... 2076151

[51] Int. Cl.[6] ..... B63B 23/00

[52] U.S. Cl. ..... 114/259; 114/51

[58] Field of Search ..... 114/244, 258, 259, 270, 114/51

[56] References Cited

U.S. PATENT DOCUMENTS 3,807,335 4/1974 Talkington .
3,937,163 2/1976 Rosenberg .
3,943,875 3/1976 Sanders ..... 114/244
3,955,522 5/1976 Gaudiano et al. .
4,516,517 5/1985 Ayers .

*Primary Examiner*—Jesüs D. Sotelo
*Attorney, Agent, or Firm*—Ronald G. Bitner

[57] ABSTRACT

A system for handling a remote vessel from a mother vessel comprising: a messenger/manipulating line intercepting member extending upwardly from the remote vessel; a line capturing device associated with the line intercepting member; line traversing device for transferring the line to the line capturing device; a messenger/manipulating line associated with the mother vessel for engaging the line intercepting device and capturing by the line capturing device of the remote vessel; and a winch associated with the messenger/manipulating line for manipulating the remote vessel. For one embodiment of the invention, the system may additionally include a line capturing and lifting hook attached to the remote vessel; a hoisting winch and hoisting cable with hook for attachment to the lifting hook attached to the remote vessel; and a second messenger line for releasable attachment to the hoisting cable for capture by the lifting hook and to provide attachment of the hoisting cable to the lifting hook.

17 Claims, 8 Drawing Sheets

SYSTEM FOR HANDLING A REMOTELY OPERATED VESSEL

FIELD OF THE INVENTION

This invention relates to a system for handling a remotely operated vessel or submersible, and specifically for launching and recovering such a vessel from a larger surface vessel.

BACKGROUND OF THE INVENTION

The retrieval of an object at sea is a difficult task in anything but the most calm conditions. The task is made more difficult when the retrieval is attempted from another floating object such as a ship. The continuous movement of the water imparts motion to each vessel, and since the vessels will be of different mass and shape, the motion of the vessel to be recovered will be different from that of the ship. The differing motion of the two vessels makes capture very difficult without causing damage to either vessel.

Present techniques for the recovery of remotely operated vessels or submersibles to a mother ship involve the use of diver(s) equipped with wetsuit and breathing apparatus, usually using an inflatable boat, to physically attach the prime lift hook from the ship to the vessel to be recovered after initially restricting the vessel's movement by attaching messenger lines from the ship. With manned support vessels, the lifting lines must also be secured by hand.

To avoid danger to humans, the operations of vessel capture, lift and motion control are preferably done remotely.

Various systems have been proposed for the recovery of submersibles or other vessels. Examples of prior systems are disclosed in U.S. Pat. Nos. 3,807,335, 3,937,163, 3,955,522, and 4,516,517.

The existing systems are not entirely satisfactory in providing a simple system for launching and recovering a smaller vessel safely from a mother vessel.

SUMMARY OF THE INVENTION

An object of the present invention is to remotely attach a line to a remote vehicle from a mother vessel so that it can be safely brought aboard.

It has been found that a line can be remotely attached to a remote vessel from a mother vessel with a system that includes the use of a messenger/manipulating line on the mother vessel in cooperation with a line arresting and capturing means on the remote vessel for longitudinal positioning and/or hoisting.

In accordance with the present invention there is provided a system for handling a remote vessel from a mother vessel comprising: the remote vessel having a line intercepting member extending upwardly from the remote vessel; a line capturing device associated with the line intercepting member; line traversing means for transferring the line to the line capturing device; a messenger/manipulating line associated with the mother vessel for engaging the line intercepting device and capturing by the line capturing device of the remote vessel; and a winch associated with the messenger/manipulating line for manipulating the remote vessel.

DESCRIPTION OF THE PREFERRED EMBODIMENTS

Figure 1:
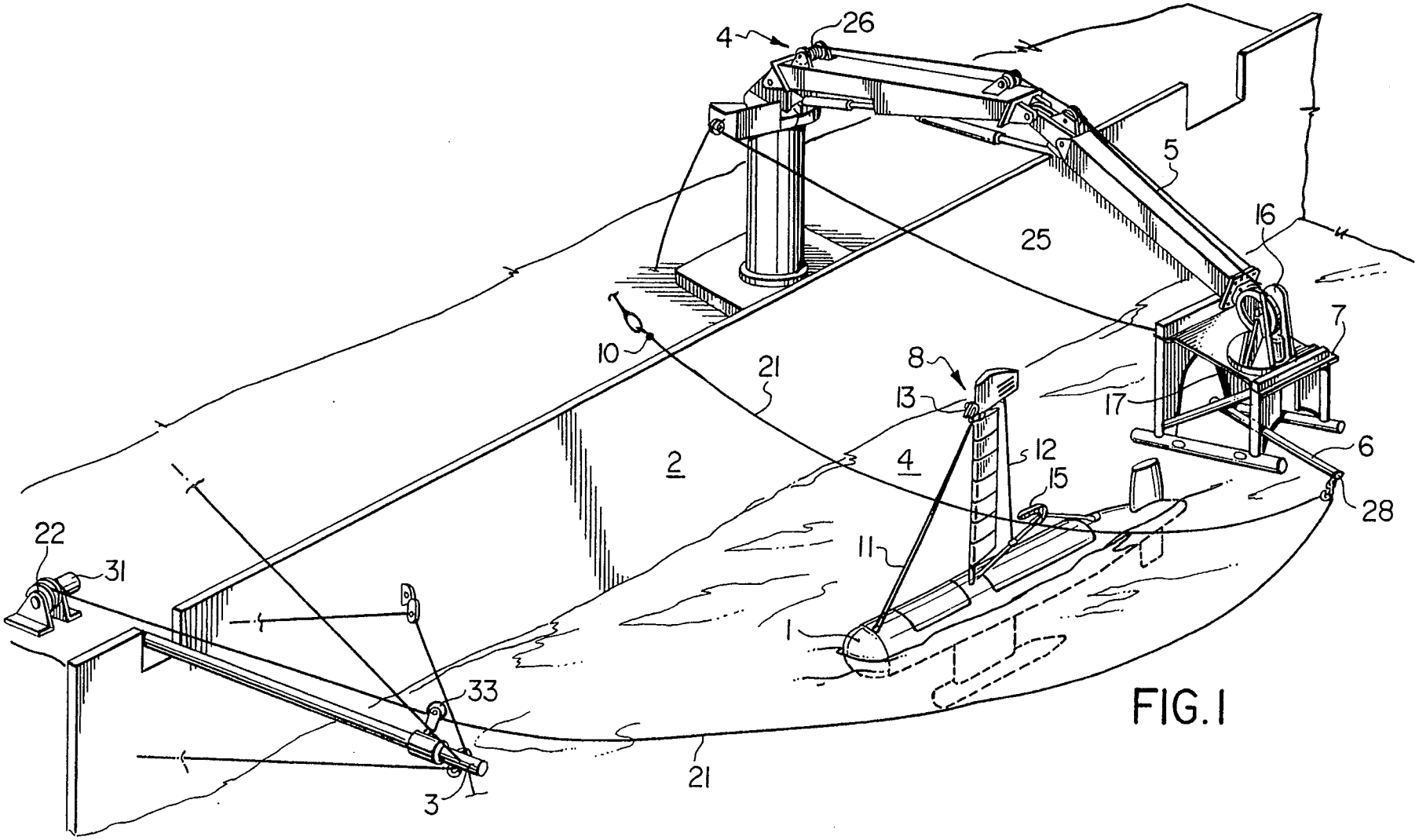
FIGS. 1 to 5 illustrate one embodiment of the invention showing several stages in the recovery of a remote vessel from a mother vessel.

With reference to FIGS. 1 to 8 which illustrate one embodiment of the invention for the recovery of a remote vessel 1 by a mother vessel 2. The mother vessel 2 includes a towing boom 3, a crane 4 with a boom 5, having a line supporting member 6, and a cradle 7. The remote vessel 1 has an upwardly extending messenger/manipulating line intercepting member 8 shown in the form of a mast 9. Cooperating with the line intercepting means 8 is towline 11 that defines messenger/manipulating line traversing or guide means, as will be described. A rear stay 12 defines rear guide means. Cooperating with the guide means 11 is line capturing device 13 in the form of a hook releasably supported at an upper and rearward portion of the guide means 11. The line capturing device 13 is attached to the guide means defining towline 11 which is connected to a forward portion of the vessel for towing.

Figure 6:
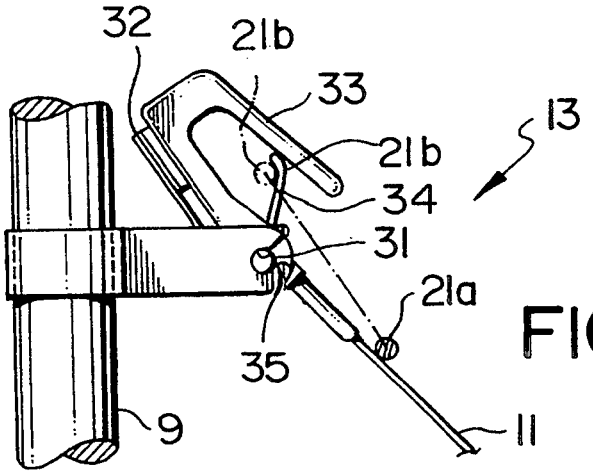
FIGS. 6 and 7 are enlarged views showing details of one embodiment of a line capturing device at various stages of operation for a system such as illustrated in FIGS. 1 to 5.
Figure 7:
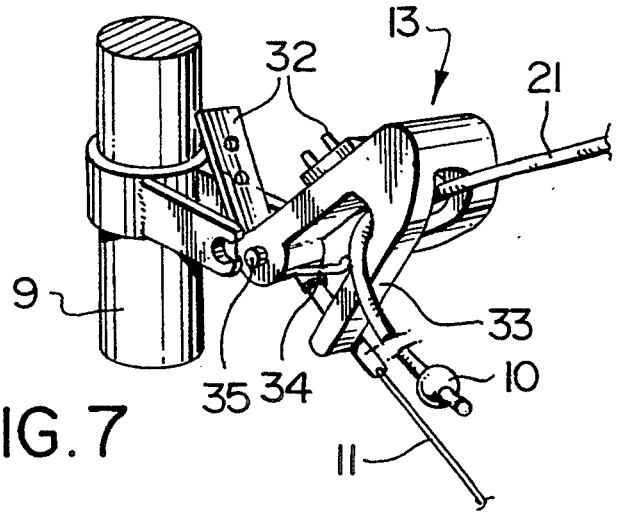
Figure 8:
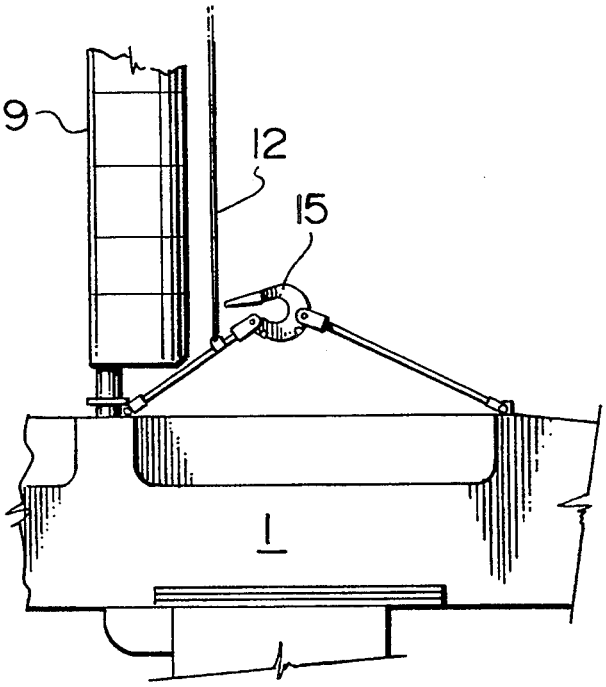
FIG. 8 is an enlarged view showing details of the lifting frame of the remote vessel.

As shown in FIGS. 6 and 7 the line capturing device 13 is releasably supported by means of pin 31 and releasable retention means 32. The capturing mechanism comprises a hook 33 with spring gate 34. The geometry of the pin 31 allows release from recess 35 upon rotation of the device about the pin 31 when pulled by the messenger/manipulating line 21.

The cradle 7 is shown pivotally connected to the crane boom about an axis parallel to the longitudinal axis of the ship, and includes braking means 16 to selectively damp and lock the cradle 7 with respect to the crane 4 to prevent pivoting. The cradle will preferably have a compressible lining or pads 17 to avoid damaging the hull of remote vessel. The cradle 7 will preferably also have locking means shown in the form of a locking plates 18 for securing the remote vessel within the cradle 7.

Associated with the towing boom 3 is messenger/manipulating line 21 and towing winch 22. The free end of the messenger/manipulating line 21 is terminated with a suitable stopper 10 adapted to engage with the hook of the line capturing device 13.

Figure 10:
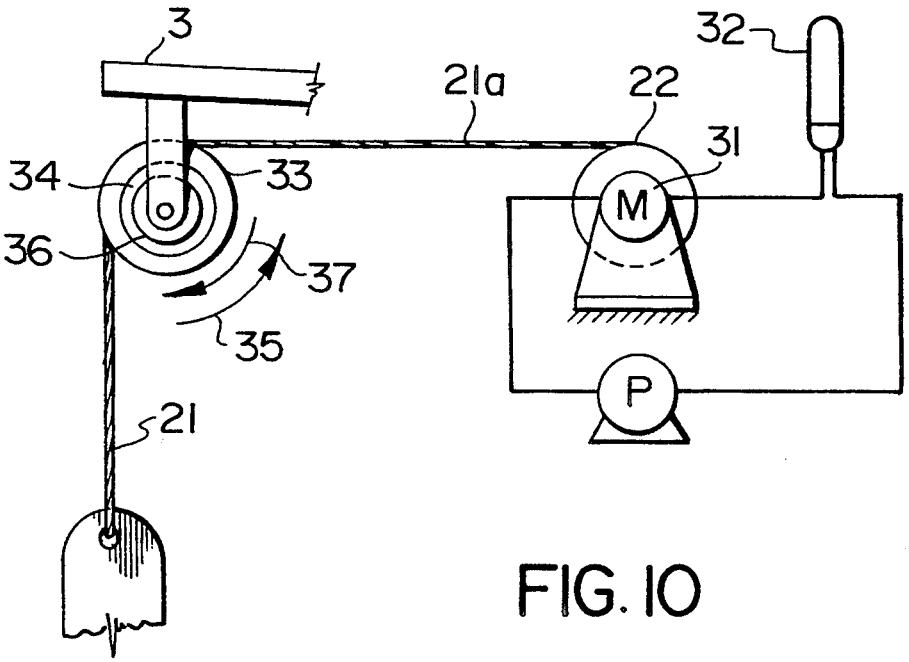
FIG. 10 is a schematic view showing details of the tension limiting system.

The towing system will preferrably be provided with tension limiting means and spooling control means, in association with the winch 22, as illustrated schematically in FIG. 10. The tension limiting system comprises a hydraulic motor 31, which drives winch 22, and accumulator 32. The accumulator 32 is connected with the inlet of the hydraulic motor 31 to reduce shock loading and take up slack line on the messenger/manipulating line 21 due to relative motion between the two vessels 1 and 2, for both the recovery or deployment operation. Tile spooling control means includes sheave 33 on boom 3 which is provided with a one way clutch 34 that allows the sheave to free-wheel, in direction 35, when line 21 is paying out, and braking or torque limiting means 36. Torque limiting of the sheave 33, in the direction 37, for hauling in, provides a minimum amount of tension in section 21*a* of the line 21 between the sheave 33 and winch drum 22 to facilitate proper spooling onto the winch drum 22.

Figure 9:
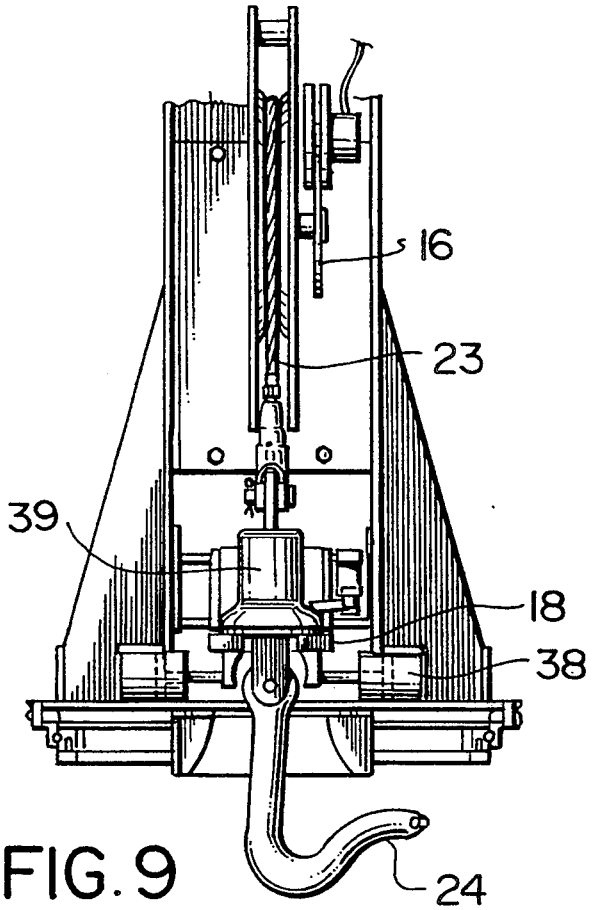
FIG. 9 is an enlarged view showing details of the locking means for hoisting.

Associated with the cradle 7 is a hoisting cable 23 with crane hook 24. With specific reference to FIG. 9, locking means are shown for locking the hook 24 relative to the cradle 7. The locking means comprises locking plates 18, actuated by hydraulic cylinders 38, which engages the enlarged element 39 on line 23.

A hoisting winch 26 cooperates with the hoisting cable 23 for lifting the remote vessel upwardly into the cradle 7. Releasably attached to the hoisting cable 23 is a second messenger line 25 adapted to be captured by the remote vessel hook 15.

Attached to boom 5 or cradle 7 and extending outwardly away from the mother vessel is a messenger line supporting member 6. Disposed at the end of the member 6 is a releasable hook 28 for releasably supporting the messenger/manipulating; line 21, and optionally messenger line 25, in the recovery operation. The line support member 6 forms an extension that is used to provide a larger target and allow the vehicle to make its initial approach further away from the mother vessel.

In the recovery operation, with initial reference to FIG. 1, the towing boom is shown in the substantially horizontal recovery position. The messenger/-manipulating line 21 is fed from the winch 22, to sheave or pulley 33, to the releasable hook 28 on the line supporting member 6. From here the line 21 is fed to the side of the mother vessel near the crane. The crane is slewed to the recovery position as shown in FIG. 1, with the extension boom 6 in a substantially horizontal position.

The messenger/manipulating line 21 is paid out to form a loop of line between the end of member 6 and side of the mother vessel 2. The remote vessel 1 manoeuvres so that it is aligned with the loop, then moves forward so that the messenger/manipulating line guide means/towline 11 contacts the loop of line 21. Continuing forward causes the line 21 to ride up along the guide means 11 to be captured by the line capturing hook 13. As shown in FIGS. 6 and 7 the line passes upward (from position 21*a*) through the spring gate 34 to the captured position 21*b*. When the captured line 21*b* is pulled, the hook is released from the releasable retention means 32 and is free to rotate about pin 31. Rotation about the pin 31 allows release from recess 35, freeing the line 21, hook 33 and attached towing line 11 from the mast 9, as shown in FIG. 7.

Figure 2:
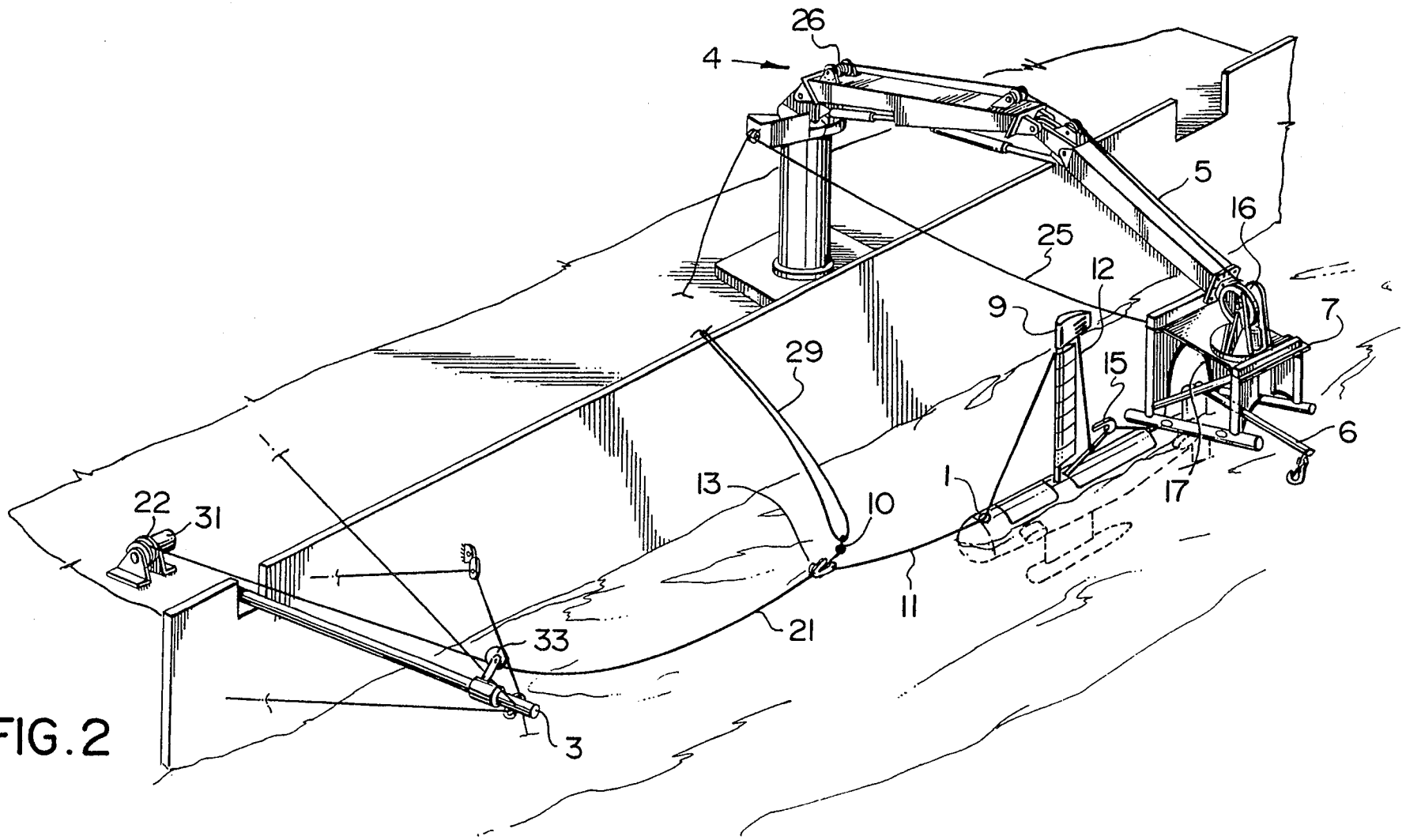
Figure 3:
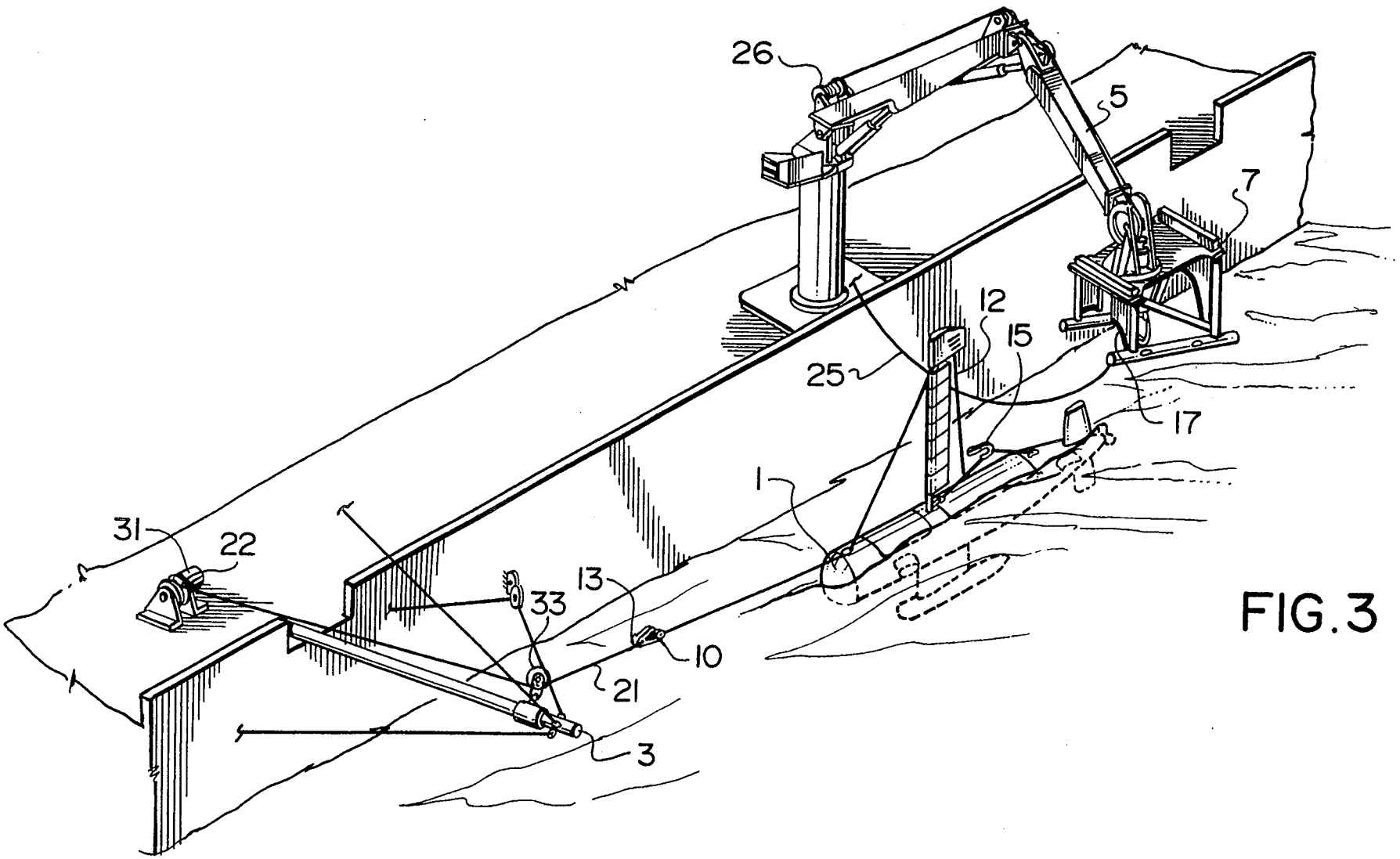
Figure 4:
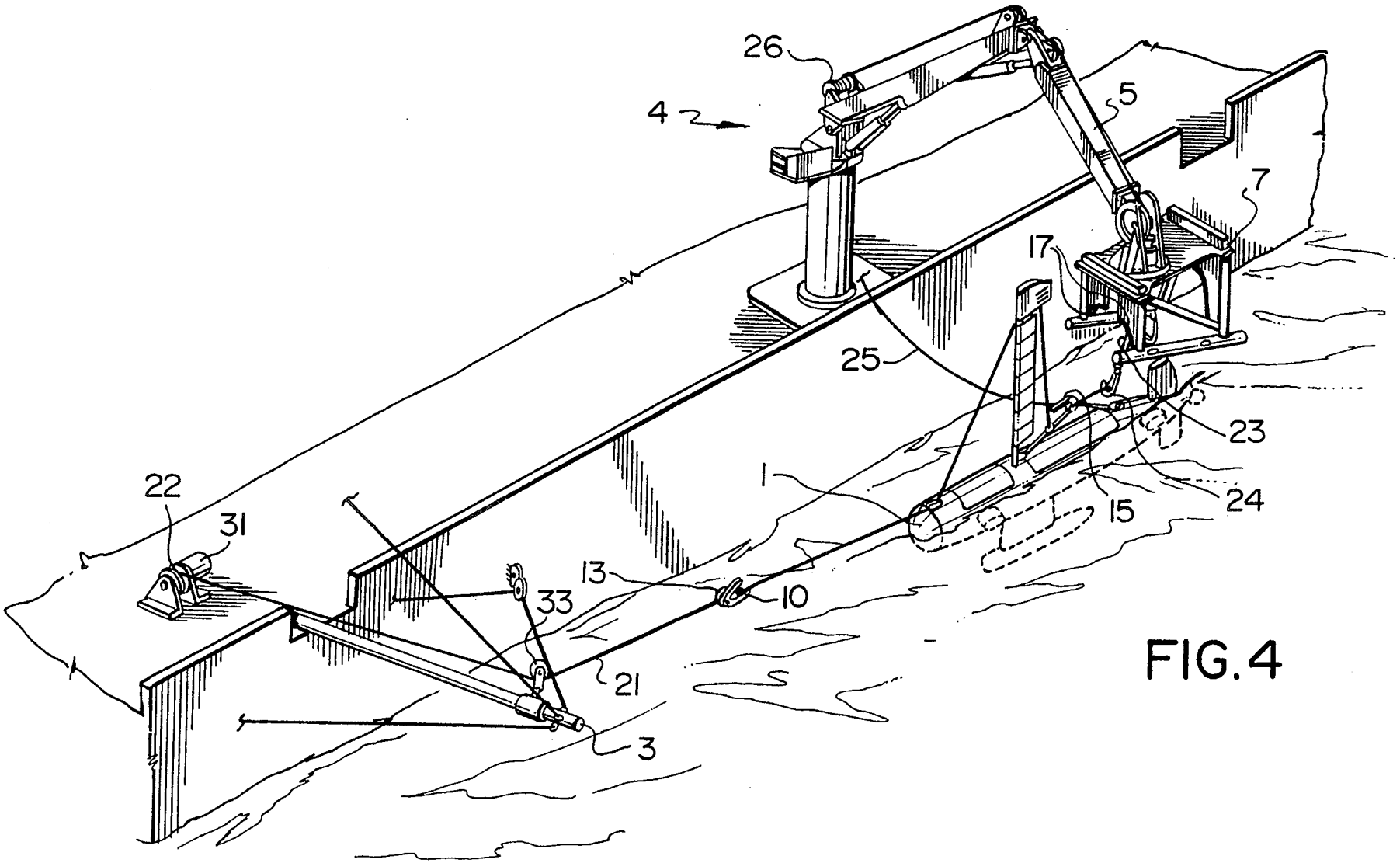

Referring to FIG. 2, as the vessel moves aft or maintains its position, the messenger/manipulating line 21 moves through the hook 13 until it comes in contact with the stopper 10 at the end of the line 21. Before the stopper engages the hook 13, the releasable hook 28 on the crane boom extension is opened, freeing the messenger/manipulating line 21.

Just prior to engagement of the stopper 10 with the hook 13, a previously installed slipping line 29 that passes through stopper 10 is released.

The remote vessel is now being towed from the towing boom 3, as shown in FIG. 2. Using the winch 22, the remote vessel is moved forward of the crane 4.

Next, the second messenger line 25 is presented in the form a loop of line between the cradle 7 and the side of the mother vessel 2, to create a target for the remote vessel 1.

Figure 5:
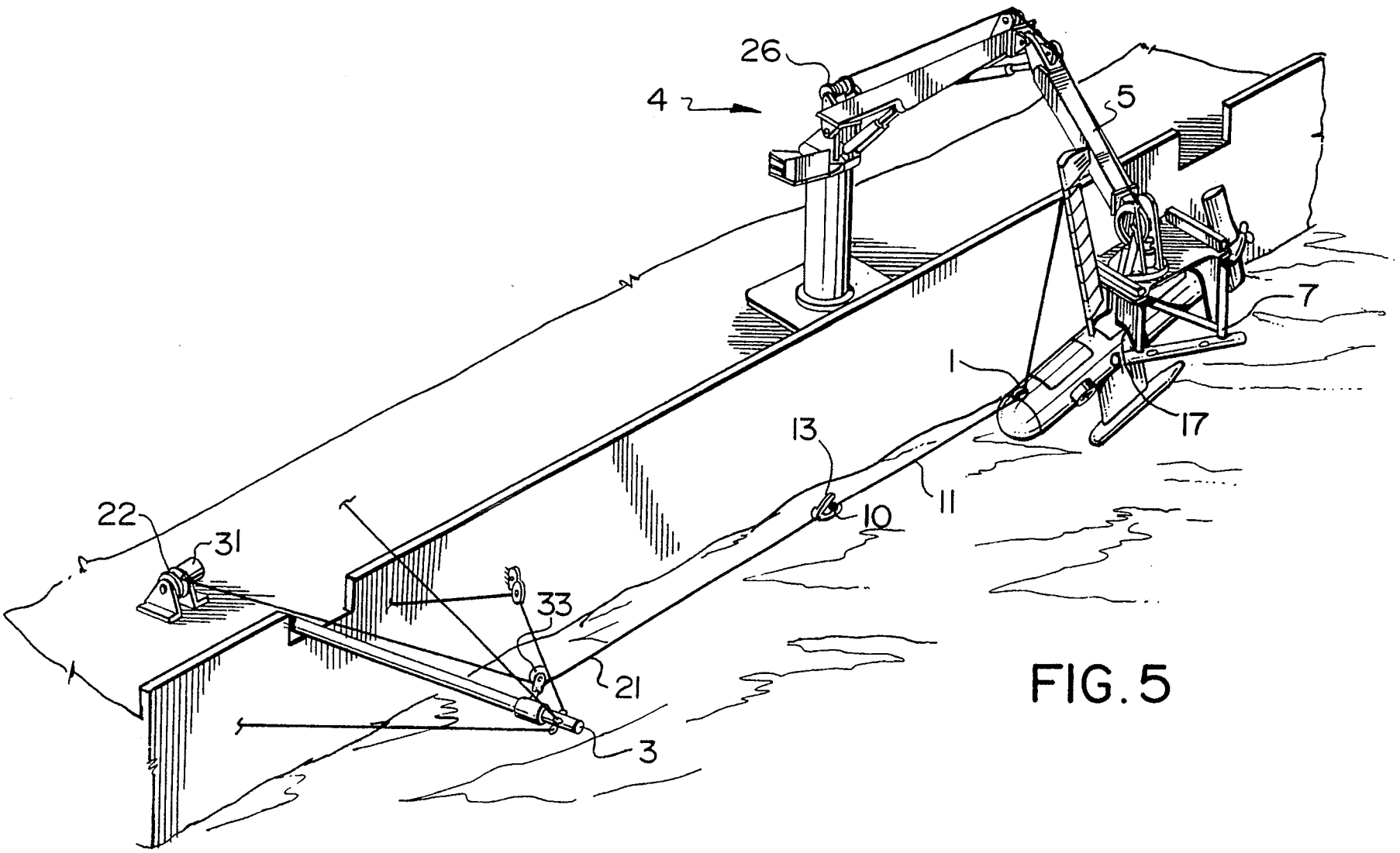

From its forward position ahead of the crane 4, the remote vessel is moved aft, using the winch 22, until the line 25 contacts the rear guide means 12. The remote vessel is then moved further aft a small distance to ensure positive contact. The weighted messenger/-manipulating line 25 is then allowed to fall into the space between the lifting frame and the rear guide means 12. The remote vessel is then moved slightly forward of the crane to ensure that the line cannot escape. With the crane winch in minimum constant tension mode (adjusted so that the crane hook 24 slowly falls under its own weight, tension is maintained on messenger line 25 until the hook 24 engages with the remote vessel hook 15. (See FIG. 4) As soon as the hooks are engaged, the crane winch 26 is put into maximum constant tension mode, allowing the cable to pay in and out as the vessel rides on the waves. While hoisting, the winch 22 is used to ensure that the vessel is positioned slightly forward of the crane, so that the hoisting cable 23 is at a small angle from vertical. The magnitude of this angle depends on the sea state present, but should be sufficient such that line 21 does not go slack due to pitching of the mother vessel 2. Preferably, the remote vessel will be hoisted from the water while on the crest of a wave. While hoisting the remote vessel, it may be necessary to manipulate the messenger/-manipulating line 21 to provide correct positioning of the vessel for proper entry into the cradle. The remote vessel is brought up tight within the cradle to partially compress the compressible lining 17 within the cradle 7. A limit switch will preferably be used to cut power to the crane winch 26 when the vehicle is in the correct position, thus providing protecting against damaging the remote vessel if hoisted too far. Once power to the crane winch is cut, locking plates 18 are closed (see FIG. 9). Once closed, the crane hook 24 can be lowered until its swivel rests on the locking plates (the compressible lining 17 remains compressed in this position). The hoisting cable 23 can then be slackened or put into maximum constant tension mode. Secured in the cradle 7, as shown in FIG. 5, the crane 4 moves the remote vessel to its seat aboard the mother vessel. As it is moved, pressure is gradually applied to the brake 16 so that the brake is locked just before remote vessel is placed into its seat.

For the launching operation, the crane hook 24 is connected to the remote vessel hook 15 and, with the crane winch 26 in maximum constant tension mode to take up slack cable, the brake is locked and the cradle is positioned to its correct location. The locking plates 18 are then closed and the hoisting cable 23 made slack or put into maximum constant tension. The guide means/-towline 11 and line capturing device 13 are put in their correct position for recovery.

The towing boom 3 is moved into the towing position and the line 21 is led from the winch 22 and attached to the remote vessel with a suitable releasable fastener. The crane boom 5 is manoeuvred to the launching position as shown in FIG. 5. The brake 16 is gradually released so that the cradle is free to pivot, and the line 21 is put under tension using the winch 22 so that it maintains the remote vessel parallel to the mother vessel. The locking plates 18 are opened and the remote vessel is lowered by paying out the hoisting cable 23. This action is preferably done as rapidly as possible. Tension is maintained on the line 21 to minimize motion and also to keep the upwardly extending mast 9 slightly forward of the cradle 7 when disengagement occurs.

When the remote vessel is waterborne, the crane hook 24, which has been reversed, i.e., positioned 180 degrees to the recovery position, is immediately released by pulling on messenger line 25, which has been fed through a small ring or shackle at the back of hook 24 to provide the mechanical advantage necessary for release. Once released, the crane 4 is immediately slewed rearward and away from the remote vessel. Line 21 is then released by pulling a line attached to the release hook. Upon release, power is applied to remote vessel 1 to move it away from the mother vessel 2.

Figure 11:
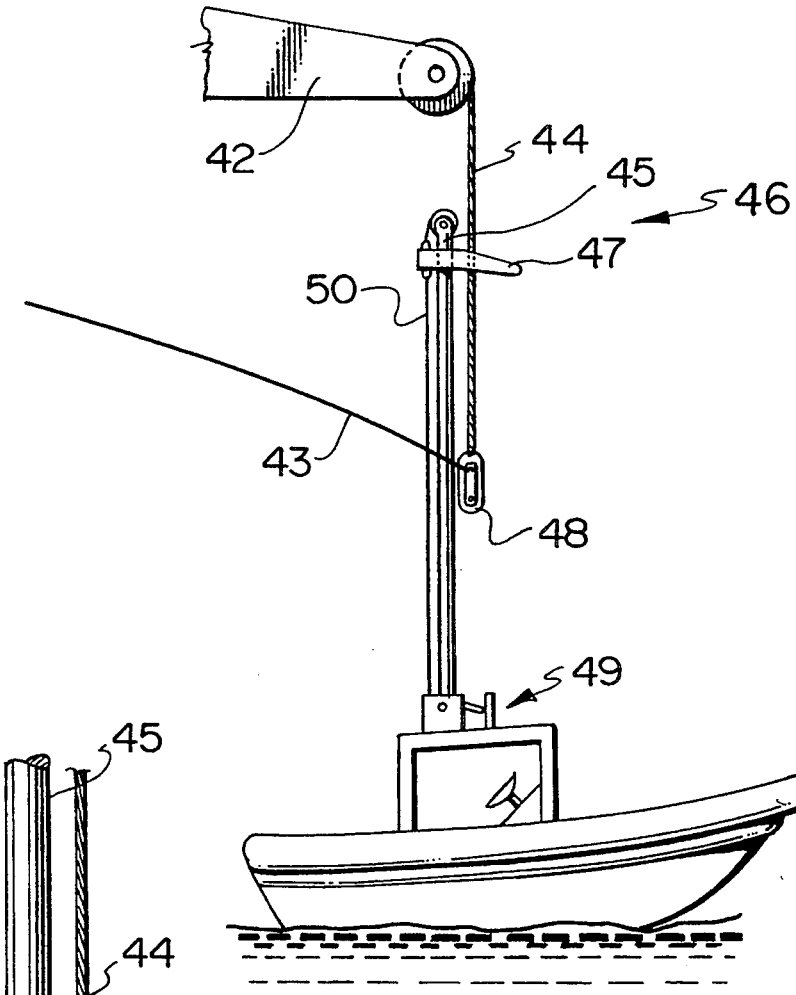
FIG. 11 illustrates an alternate embodiment of the invention showing a remote vessel positioned for recovery by the crane of a mother vessel.
Figure 12:
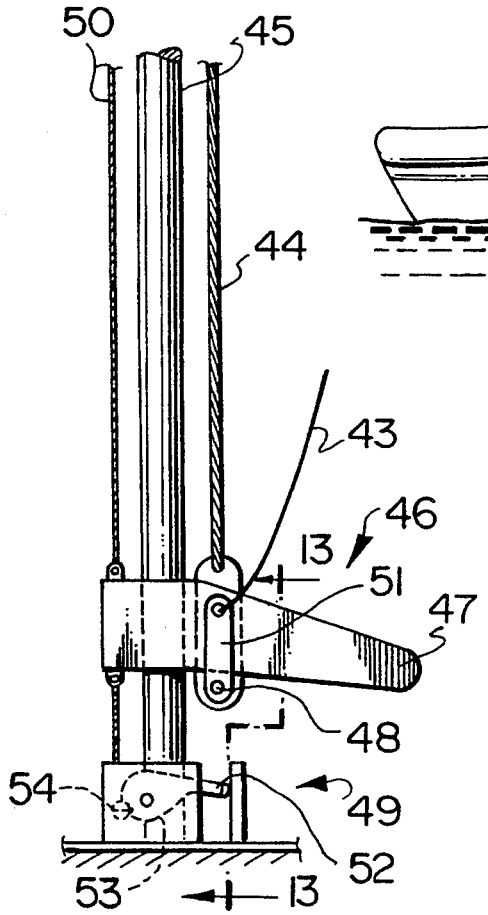
FIGS. 12 and 13 are enlarged views showing details of the capturing mechanism shown in FIG. 11.
Figure 13:
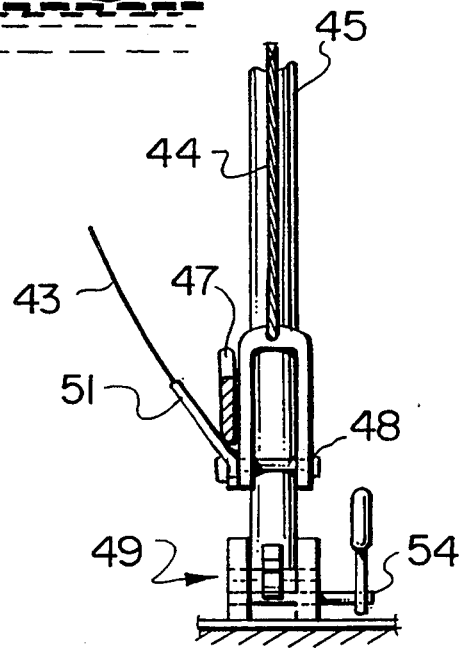

FIG. 11 to 13, illustrate another embodiment of the present invention for the recovery of a remote vessel 41 by a mother vessel having a crane or davit 42. Associated with the mother vessel is a messenger line 43 and remote vessel manipulating line 44. The remote vessel 41 has an upwardly extending messenger line intercepting member 45, which may be in the form of a retractable mast. The line intercepting member 45 may be flexible. Cooperating with the line intercepting member 45 is line capturing means including line traversing means 46 comprising a generally horizontally extending member 47, a lift hook 48 and latch means 49. The horizontally extending member 47, driven by suitable means 50, travels along the line intercepting member 45 and transfers the lift hook 48 to engage the latch 49. The lift hook 48 is shown to include a positioning element 51 to which the messenger line is attached. The extending member 49 and element 51 have complementary geometry to orient the hook 47 upon engaging one another so that the lift hook 48 will properly engage the latch 49.

As detailed in FIGS. 12 and 13, the latch 49 comprises a latching element 52 forming portion of a rotatable cam 53 which is selectively retained in a latching or release position by rotation of pin 54.

In operation, messenger line 43 is attached to the lift hook 47, and specifically to the positioning element 51 which is attached to the lift hook 48, and deployed from the mother vessel in the path of the remote vessel 41. As the remote vessel approaches the messenger line, the remote vessel 41 will have the messenger line intercepting member 45 in the raised position as shown. Also the line traversing means 46 will be in the raised position so that the messenger line 43 passes under the horizontally extending member 47. When the messenger line 43 is intercepted by member 45, the messenger line is pulled to draw the lift hook 48 against the horizontally extending member 47, whereby positioning element 51 ensures proper orientation of the lift hook. The horizontally extending member 47 is then brought downward, by means 50, along the line intercepting member 45, carrying with it the lift hook 48 to engage the latch 49.

It should be noted that in the embodiment of FIGS. 11 to 13, manipulation of the vessel, after capturing of the line, involves hoisting, while in the embodiment of FIGS. 1 to 5, manipulation involves longitudinal positioning and/or towing with hoisting done in a separate operation.

It will also be noted that in the embodiment of FIGS. 1 to 5, the line traversing means for transferring the line is preformed by passive guide means 11 while in the embodiment of FIGS. 11 to 13 the traversing means is in the form of the travelling member 47.

The embodiment as shown in FIG. 11 uses a single lift point on the remote vessel. An alternate arrangement may involve two lift points, positioned fore and aft on the remote vessel. With a single lift point, a bowline may be used for stability and positioning.

It will be appreciated that the present invention may be used with various types of remote vessels, and that some modifications to some of the components may be required to accommodate such different vessels. For example, the design of the cradle, if used, will be determined by the size and shape of the remote vessel and the arrangement of the mast, if any. As an alternative to the inverted U-shaped cradle illustrated in the drawings, the cradle may be presented sideways. The crane and other associated equipment on the mother vessel can take various forms, for example, the crane could be a telescoping boom crane as well as a knuckle boom crane, as shown in the drawings. To provide support for the messenger line guiding means, a remote vessel without a mast or upper structure may be equipped with a deployable mast that raises the messenger line guiding means when required for the recovery operation.

What is claimed is:

1. A system for handling a remote vessel from a mother vessel comprising:
   - a messenger/manipulating line intercepting member extending upwardly from the remote vessel:
   - a line capturing device associated with the line intercepting member;
   - line traversing means for transferring the line to the line capturing device;
   - a messenger/manipulating line associated with the mother vessel for engaging the line intercepting device and capturing by the line capturing device of the remote vessel; and
   - a winch associated with the messenger/manipulating line for manipulating the remote vessel.

2. The system of claim 1, wherein the line traversing means comprises guide means cooperating with the line intercepting member for directing the line to the line capturing device.

3. The system of claim 2, wherein said guide means defines a sloping front surface, and wherein said line capturing device is releasably supported at a rearward portion of the guide means.

4. The system of claim 3, wherein the guide means is in the form of a line connected to a forward portion of the remote vessel for towing.

5. The system of claim 1, wherein the messenger/-manipulating line intercepting member comprises a mast.

6. The system of claim 1, wherein the line traversing means comprises a movable member movably supported by the messenger/manipulating line intercepting member for travel between a position distant from the line capturing device to a position in proximity with the line capturing device.

7. The system of claim 1, wherein the line capturing device comprises a hook disposed in proximity to the line intercepting member, said hook including retention means for retaining the messenger/manipulating line upon entry.

8. The system of claim 1, further comprising a towing boom disposed on the mother vessel and wherein said winch associated with the messenger/manipulating line operates to tow and longitudinally position the remote vessel relative to the mother vessel.

9. The system of claim 1, further comprising a boom with a vessel receiving cradle mounted on the mother vessel.

10. The system of claim 9, further comprising a messenger line supporting member extending outwardly from the cradle, said line supporting member having a releasable line supporting hook disposed at an outer region thereof.

11. The system of claim 9, further comprising pivotal connection means for pivotally connecting the cradle to said boom about a longitudinal axis and having braking means to selectively lock the motion of the cradle with respect to the boom.

12. The system of claim 9, further comprising locking means for locking the remote vessel into the cradle.

13. The system of claim 9, further comprising:

a line capturing and lifting hook attached to the remote vessel;

a hoisting winch and hoisting cable cooperating with said vessel receiving cradle, and wherein said cable includes a hook for connecting with the lifting hook attached to the remote vessel; and a second messenger line for releasable attachment to the hoisting cable for capture by the lifting hook and to provide attachment of the hoisting cable to the lifting hook.

14. The system of claim 13, further comprising a constant tension device associated with the hoisting cable.

15. The system of claim 1, further comprising tension limiting means associated with the winch.

16. The system of claim 15, wherein the tension limiting means comprises an hydraulic system with an accumulator for reducing shock loads in the messenger/-manipulating line due to relative motion between the two vessels.

17. The system of claim 1, further comprising spooling control means associated with the winch, said spooling control means comprising a sheave for directing the messenger/manipulating line to the winch, said sheave having a one way clutch that allows the sheave to freewheel when the line is paying out, and torque limiting means to provide a minimum amount of tension in the section of the line between the sheave and winch to facilitate proper spooling of the line onto the winch.

* * * * *